US005448914A

United States Patent [19]

Van Middeldorp

[11] Patent Number: 5,448,914

[45] Date of Patent: Sep. 12, 1995

[54] SYSTEM FOR MEASURING THE PENETRATION DEPTH OF AN ELONGATED OBJECT INTO THE GROUND

[75] Inventor: Frederik M. Van Middeldorp, Maassluis, Netherlands

[73] Assignee: Nederlandse Organisatie voor Toegepast-Natuurwetenschappelijk, Delft, Netherlands

[21] Appl. No.: 212,517

[22] Filed: Mar. 11, 1994

[30] Foreign Application Priority Data

Mar. 15, 1993 [EP] European Pat. Off. ..... 93200752

[51] Int. Cl.[6] ..... G01B 5/18

[52] U.S. Cl. ..... 73/432.1; 33/719; 33/713; 173/21; 175/45

[58] Field of Search ..... 73/84, 432.1, ; 33/700, 33/719, 720, 713, 715, 701, 721; 173/21, 147, ; 175/40, 45; 405/232

[56] References Cited

U.S. PATENT DOCUMENTS

| | | | |
|---|---|---|---|
| 2,658,725 | 11/1953 | Arps | 173/21 |
| 3,437,156 | 4/1969 | Laverty | 173/21 |
| 3,474,539 | 7/1969 | Moore | 33/719 |
| 3,543,868 | 12/1970 | Drake | 173/21 |
| 3,902,361 | 9/1975 | Watson | 73/151 |
| 4,188,726 | 2/1980 | Wemyss | 33/715 |
| 4,910,878 | 3/1990 | Fleckenstein et al. | 33/719 |

FOREIGN PATENT DOCUMENTS 810192436 11/1981 Japan .

*Primary Examiner*—Hezron E. Williams
*Assistant Examiner*—Nashmiya Ashraf
*Attorney, Agent, or Firm*—Bachman & LaPointe

[57] ABSTRACT

System for measuring the penetration depth of an elongated object such as a pile, tube, sheet pile or drill into the ground, to be used in combination with an installation for bringing the elongated object into the ground for instance by pressing, hammering, vibrating, drilling or lowering, or for pulling or otherwise removing the elongated object out of the ground. The system comprises a member for measuring the displacement of the elongated object embodied as a flexible elongated element the weight of which is uniformly distributed along its length, the length being at least equal to the maximum displacement of the elongated object. At least part of the elongated element is supported by a supporting surface. Structure is present to determine the total weight of that section of the flexible elongated element which is supported by the supporting surface.

20 Claims, 6 Drawing Sheets

SYSTEM FOR MEASURING THE PENETRATION DEPTH OF AN ELONGATED OBJECT INTO THE GROUND

BACKGROUND OF THE INVENTION

The invention relates to a system for measuring the penetration depth of an elongated object such as a pile, tube, sheet pile or drill into the ground, to be used in combination with an installation for bringing the elongated object into the ground for instance by pressing, hammering, vibrating, drilling or lowering, or for pulling or otherwise removing said elongated object out of the ground, said system comprising means for measuring the displacement of the elongated object.

A system of this type, more specifically destined for driving a pile into the ground by means of a hammer, is described in the laid-open Japanese patent publication JP 58-94525. In this prior art system the displacement of the elongated object is measured by measuring the displacement of a wire or cable of which one end is directly or indirectly connected to the pile. The other end of the wire or cable is wound onto a drum. During operation of the system the amount of wire paid out from said drum is measured. The measured values are recorded and can be used for real time calculations. Thereby especially information is obtained about the speed with which the pile or tube is penetrating into the ground.

A specific problem with measurements of this type resides in the fact that installations for driving piles, tubes, sheet piles or drills into the ground are usually operating in a very dirty, even hostile environment. Therefore, the various components of the measuring system have to be embodied such that they will operate in a reliable manner even under said hostile circumstances. Rotating means such as a drum on which a measuring wire is wound (as described in JP 58-94525) should be avoided. A specific disadvantage related to the use of a drum resides in the fact that the error occurring during the successive revolutions of the drum is cumulating in the final measurement value, resulting in many cases in a relatively large absolute divergence between the measured value and the real penetration depth. Furthermore slip and stretching of the wire could lead to an additional deviation.

The object of the invention is now to indicate in which way accurate information can be obtained about the penetration of the pile or tube etc. with means which are basically insensitive for a dirty or even hostile environment.

SUMMARY OF THE INVENTION

In agreement with this object the invention provides a system of the above-mentioned type which is according to the invention characterized in that a flexible elongated element the weight of which is uniformly distributed along its length is directly or indirectly connected to said elongated object, said length being at least equal to the maximum displacement of the elongated object, whereby at least part of said elongated element is supported by a supporting surface, and that means are present to determine the total weight of that section of the flexible elongated element which is supported by said supporting surface.

Application of the system according to the invention results in a very easy to use and easy to calibrate measuring facility which is in essence not susceptible to a dirty or hostile environment.

In a first preferred embodiment the elongated element comprises a chain made of a plurality of interconnected links. The advantage of such an embodiment is that chains are readily available in all kinds at reasonably low costs. A chain is very insensitive for dirt, oil etc. and forms therewith an elongated element which is perfectly suited for the job.

Another embodiment of the system according to the invention makes use of a flexible element which is embodied as a wire or cable to which separate weight elements are connected at mutual distances.

It is even possible to use a flexible wire or rope as elongated element as long as its weight per unit length is sufficient to provide an accurate reading in combination with the applied weight determining means even for short displacements of the elongated object.

In a preferred embodiment the weight of the section of the flexible elongated element supported on the supporting surface is measured by means of a weight measuring device installed underneath said supporting surface. An advantage of this embodiment is that the weight measuring sensor can be connected to for instance a distant data processor or data logger by means of a connecting cable which can be installed completely out of reach of the personnel operating the system. A disadvantage of this embodiment could be that any dirt, oil, or other strange materials accumulating during the driving or removing process on the supporting surface may have influence on the weight measurement.

In another embodiment the means for determining the weight of that section of the flexible elongated element carried by the supporting surface comprises a weight measuring device installed between said one end of the flexible elongated element and the connection element or the wire or cable. Thereby in fact the weight of the section of the elongated element hanging above the supporting surface is measured. However, a simple subtraction from the initial weight provides the required weight value. An advantage of this embodiment is that any dirt, oil, or other strange materials present on the supporting plate are not influencing the measurement. A disadvantage, however, is that the measurement device should be embodied such that it is mechanically able to carry the weight of the flexible elongated element hanging from this measurement device. Furthermore the signal communication between the measurement device and the remote data logger/processor could be more complicated.

BRIEF DESCRIPTION OF THE DRAWINGS

The invention will now be explained in more detail with reference to the attached drawings.

Figure 6:
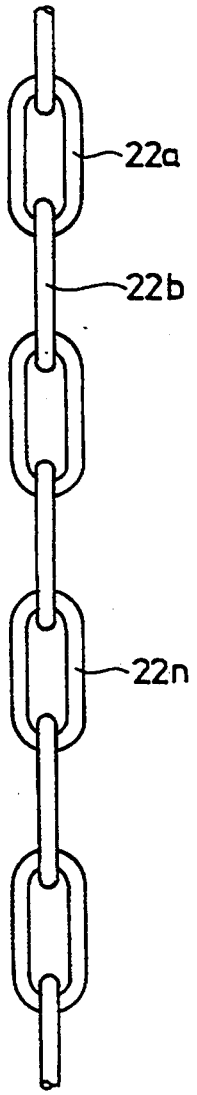
Figure 7:
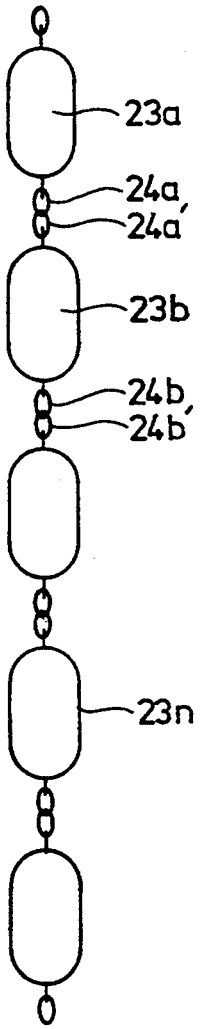
Figure 8:
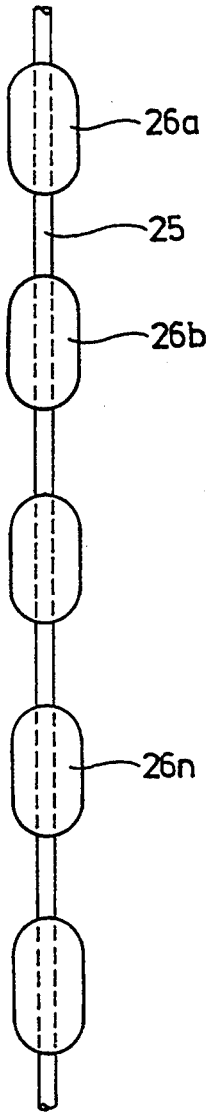

The FIGS. 6, 7, 8 illustrate various modifications of chains which can be used in the system according to the invention.

Figure 9:
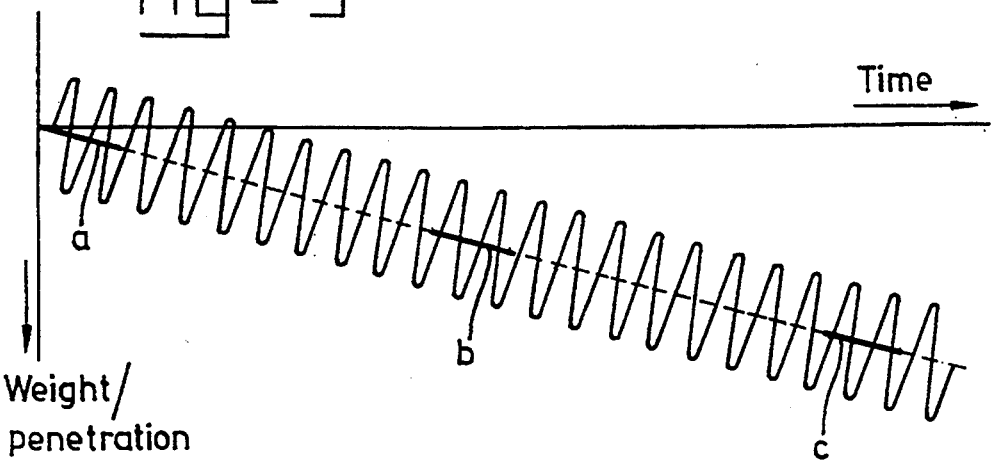

FIG. 9 illustrates a sample of a signal derived from the weight sensor in case a vibratory hammer is used in the system.

Figure 10:
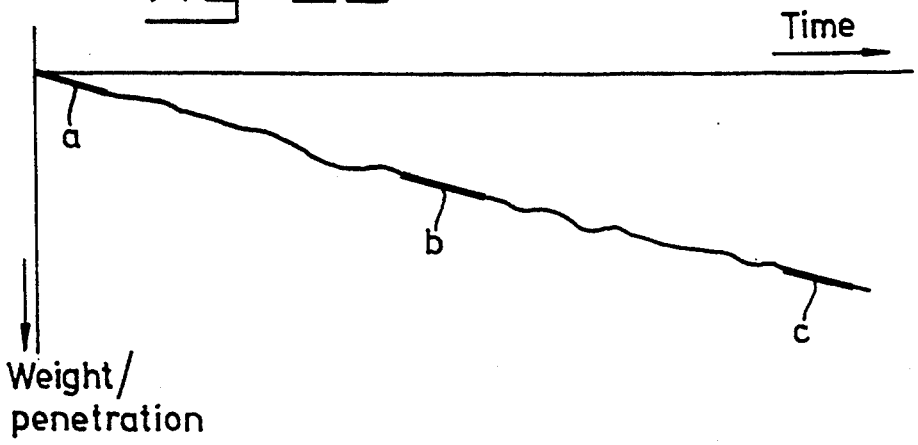

FIG. 10 illustrates a signal sample obtained from the weight sensor in case the system is used for driving a drill into the ground.

DETAILED DESCRIPTION

Figure 1:
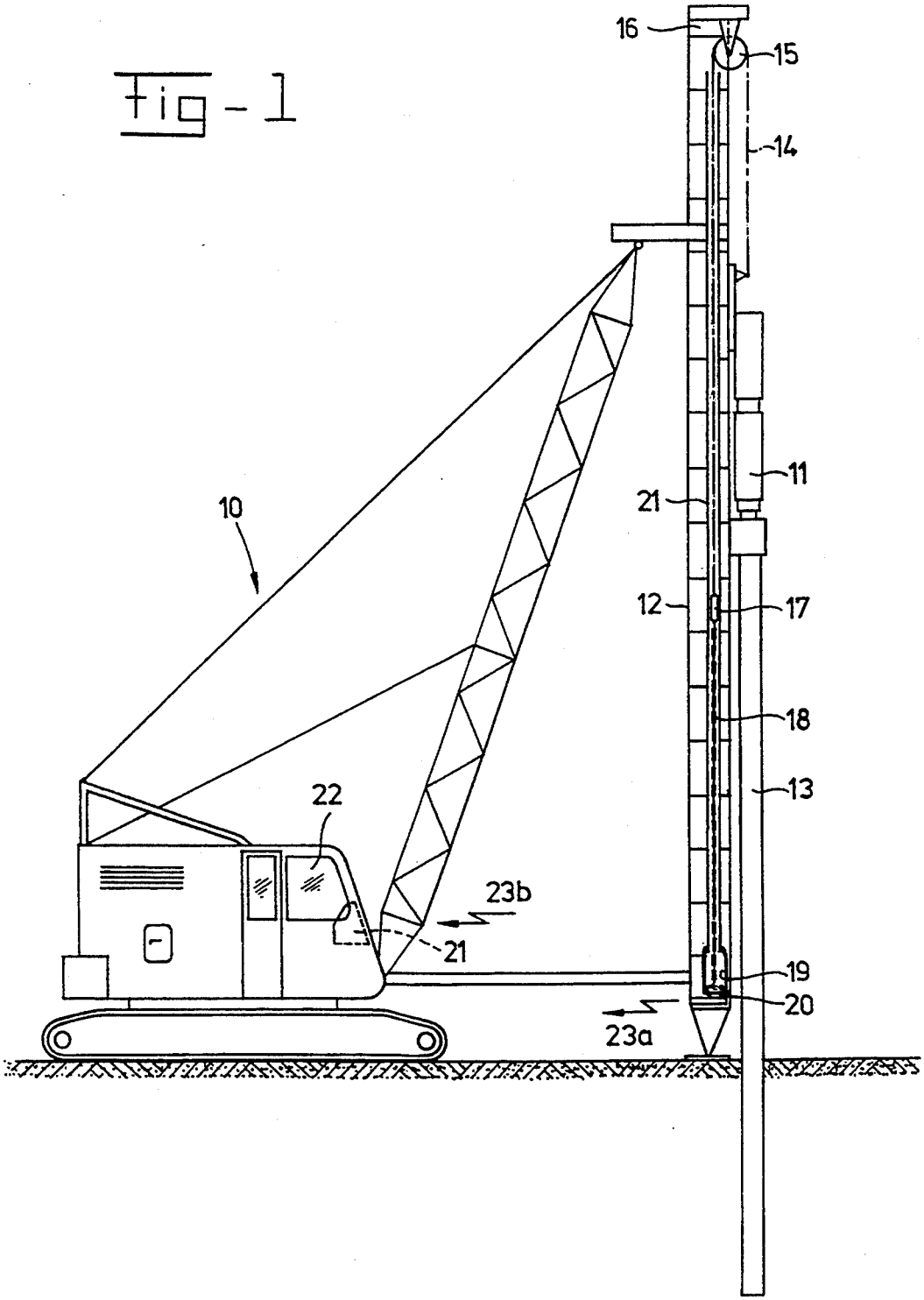
FIG. 1 illustrates schematically an installation for driving an elongated object such as pile into the-ground combined with a system according to the invention for measuring the penetration depth of said elongated object into the ground.

FIG. 1 illustrates schematically an installation for driving a pile or tube into the ground in which system the invention is embodied. The pile driving frame, comprising a lot of well-known components, is in general indicated by 10 and will not be discussed in detail assuming that the average expert is familiar with such piling rigs. The hammer unit 11 is guided along a leader 12 and is acting upon a foundation pile 13. One end of a wire or cable 14 is in this embodiment attached to a part of the hammer 11.

The installation 10 is equipped with a system according to the invention comprising as essential components the wire 14, the flexible elongated element 18 and the weight sensor 20. The wire or cable 14 runs over a pulley 15 just underneath the crown post 16 of the leader 12. From the pulley 15 the cable 14 runs downwards and ends into a connection device 17. Through this connection device 17 the respective end of the cable 14 is connected to a flexible elongated element embodied in this case as a chain 18. As is illustrated in FIG. 1 a section of the chain 18 is hanging from the wire or cable 14, another section of the cable is laying on a support surface which in this case is embodied as the bottom of a container or reservoir 19 near the lower end of the leader 12. A weight sensor 20 is installed between the container or reservoir 19 and the lower section of the leader 12 to measure the weight of that section of the cable which is still resting on the bottom of the container 19. The weight sensor in this embodiment is connected through a wireless communication link 23*a*, 23*b* to a data logger/processor combination 21 which can be installed in the cabin 22 of the system unit 10. It will be clear that for implementing the wireless communication link 23*a*, 23*b* the weight sensor 20 should be combined with at least a transmitter and the data logger/processor should be combined with a receiver. Details thereof are considered well known to the average expert.

Before the installation can be used the system according to the invention has to be calibrated. For that purpose the hammer unit 11 is moved to a first height H1, whereby preferably almost the complete weight of the chain rests upon the bottom of the container 19. In this position the weight W1 of the chain in the reservoir 19 is measured and stored in the data logger 21. Thereafter the hammer unit 11 is moved to a second height H2, whereby preferably only a small section of the chain is still resting upon the bottom of the container 19 and the weight W2 of that small section is measured and stored in the data logger 21. If the height difference H1−H2 is accurately known, then it will be clear that a displacement of the pile 13 (=a corresponding displacement of the hammer unit 11) corresponds with a measured weight difference of ΔW according to a weight per unit length of the chain (W1−W2)/(H1−H2).

As an alternative the calibration can be carried out with a non-active piling rig without moving the hammer unit. The end of the wire 14 is moved by hand to a first height H1 and the weight W1 is measured. Thereafter the end of the wire is moved by hand to a second height H2 and the weight W2 is measured. After performing the above mentioned calculation the calibration procedure is finished.

During operation first of all the pile 13 is directed alongside the leader 12 and the hamer unit 11 is brought into position on top of the pile 13. Thereafter, but before the hammer unit is activated, the weight of that section of the chain 18, which is still resting on the bottom of the container 19 is measured by means of the sensor 20 to get a weight value representing the initial situation. Thereafter the hammer unit 11 is brought into operation and with short time intervals the weight of the section, still remaining on the bottom of the reservoir is measured. In this embodiment the measured weight values will show a gradual decrease until the moment that the pile reaches a firm bottom layer. From that moment on the decrease in the series of measurement values will stop or at least slow down significantly indicating to the operating personnel, monitoring the measured values on the display of the processor 21, that the firm ground layer is reached.

As will be explained in more detail with reference to FIG. 2, preferably, the weight measurements are carried out in synchronisation with the moment at which the hammer 11 strikes the pile 13. As is described for instance in the above-mentioned Japanese specification JP 58-94525 a detecting means can be used including a vibration sensor to detect every stroke made by the hammer 11.

Figure 2:
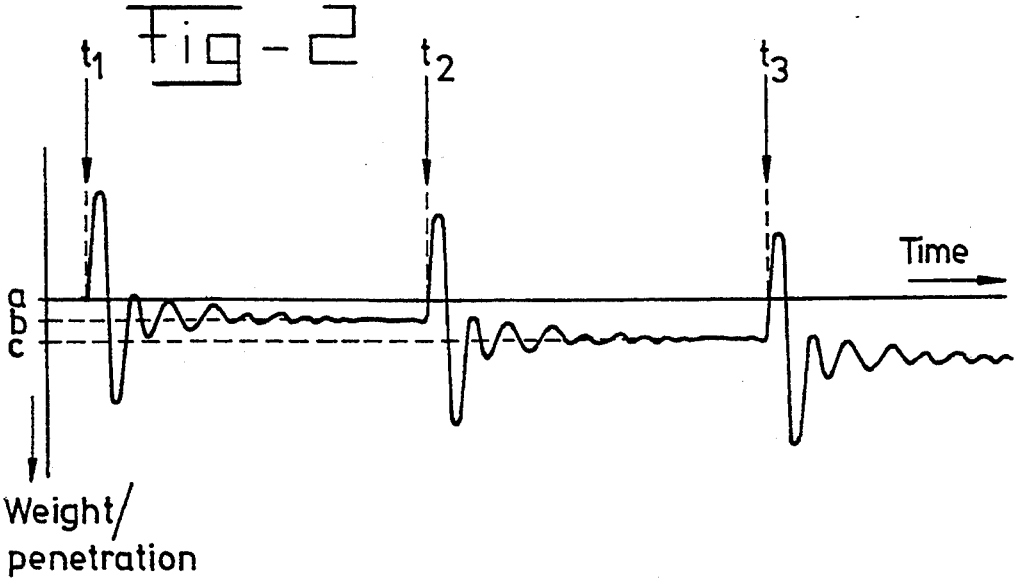
FIG. 2 illustrates a sample of the signals, derived by the weight sensor in the system according to FIG. 1.

In FIG. 2 the signal, derived from the weight sensor 20 and received through the wireless communication link 23*a*, 23*b* in the processor 21 is illustrated in FIG. 2 in which the signal amplitude, corresponding with the measured weight and therewith with the penetration depth of the pile 13 is illustrated as a function of the time. It is assumed that in the initial situation the signal starts in rest in the origin with an initial amplitude a. At time T1 the hammer 11 strikes the top of the pile 13 for the first time and the blow results into a strong oscillatory signal at the output of the weight sensor 20. In the following time period the oscillations in the signal of the weight sensor are mainly damped out such that just before the moment T2 the signal has reached approximately a steady state with an average amplitude b. It will be clear the amplitude difference a−b represents the weight of that section of the chain 18 which as result of the first blow is lifted from the supporting surface, i.e. the bottom of the reservoir 19, and represents therewith the penetration of the pile 13 as a result of the first blow.

At time T2 the hammer 11 strikes again, resulting again in a damped oscillatory signal reaching after sometime the steady state with an average amplitude c. Just before the further moment T3 the penetration depth is represented by (a–c).

Preferably the processor 21 comprises a circuit for detecting the first relatively high amplitude pulse directly following each blow. These blows are counted and the number of blows over a certain penetration depth yields the so-called "blow count". The "blow count" is a measure for the soil resistance. Furthermore the computer preferably measures the time interval between two successive blows. From this time measurement the so-called "blow rate" (the number of blows per time unit) can be calculated. In some cases the blow rate forms a measure for the hammer energy. The actual peak value of each high amplitude pulse following a blow forms a measure for the intensity of the hammer blow and the energy delivered by the hammer.

It will be clear from the above description that no additional vibration sensor is necessary for obtaining information about the number of blows, the intensity of each blow and about the number of blows per time interval.

Figure 3:
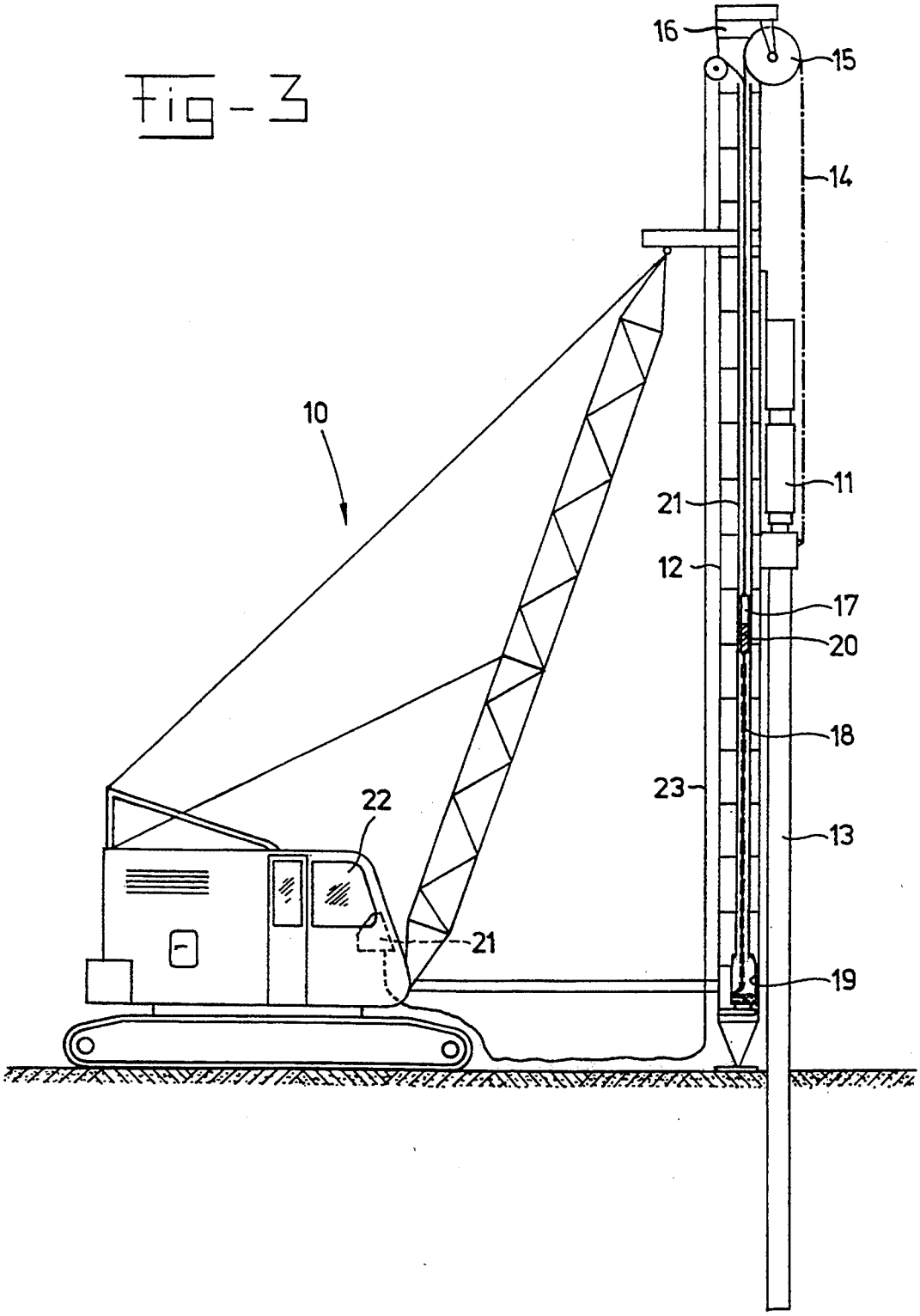
FIG. 3 illustrates another embodiment of a system according to the invention.

An alternative embodiment of the system according to the invention is illustrated in FIG. 3. The system according to FIG. 3 comprises in fact the same components as the system illustrated in FIG. 1 with the difference that the weight sensor 20 is now combined with the connection element 17. In this embodiment the weight sensor 20 measures in fact the weight of that section of the chain 18 which is actually hanging through the connection element 17 on the cable 14. It will be clear for the expert in this field that the weight sensor 20 can be attached to the connection element 17 or even incorporated therein in various ways. A further difference between this embodiment and the embodiment illustrated in FIG. 1 is residing in the fact that the weight values, measured by the sensor 20 are transferred through a wire 23 to the processor/data logger 21. The wire 23 runs in a suitable way between the sensor 20 and the processor 21. Various ways of implementing such a connection are considered known to the expert in this field, so that iris considered superfluous to provide details thereof.

It will be clear that the sensor 20 can also be installed on the hammer unit 11 such that the wire 14 is connected to the sensor 20.

Figure 4:
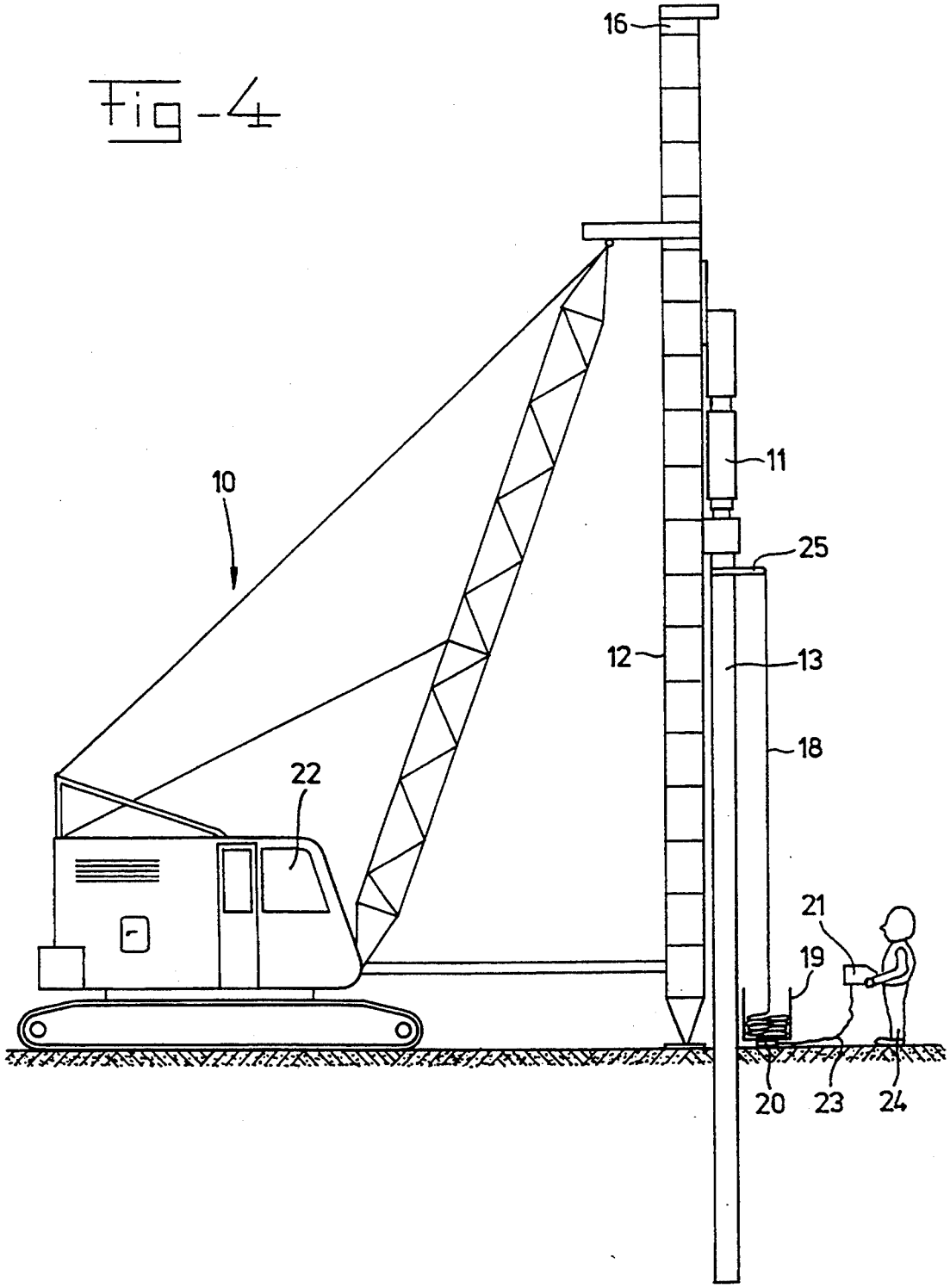
FIG. 4 illustrates a further embodiment of a system according to the invention.

To illustrate the various ways in which the invention can be implemented the wire 14 is in FIG. 3 connected to the lower part of the hammer unit 11. It is also possible to connect the wire 14 directly to the pile 13 near the top thereof as is illustrated in FIG. 4. In this figure the elongated flexible measuring element 18 is embodied as a flexible rope having a sufficient weight per length unit to enable the weight sensor 20 underneath the reservoir 19 to measure weight differences with acceptable accuracy. The signals generated by the sensor 20 are transferred through a cable 23 to the data logger/processor 21, which in this embodiment is a handhold device operated by a person 24. In this embodiment the upper end of the flexible rope 18 is connected to a clamp 25 which is fixed around or onto the top section of the pile 13. It will be clear that the upper end of the rope 18 could also be attached to the lower part of the hammer unit 11 with the same results.

In both embodiments illustrated in FIGS. 1 and 3 a protective tubing is positioned around that section of the cable or wire 14 which runs from the pulley 15 downwards inside the leader 12. This protective tubing is to be considered as an option and is not necessary for bringing the invention into practice. In FIG. 4 for instance such a tubing is not used.

In FIG. 1, FIG. 3 and FIG. 4 the leader 12 takes an upright position such that from the pulley 15 the cable 14 extends vertically. Although this situation is ideally suited to make very accurate measurements there are conditions under which piles are driven into the ground under a specified predetermined angle. However, also under these circumstances the invention can be used with very good results. Tests have been carried out with piles which were driven under an angle into the ground and the results of those tests were very satisfying.

Figure 5:
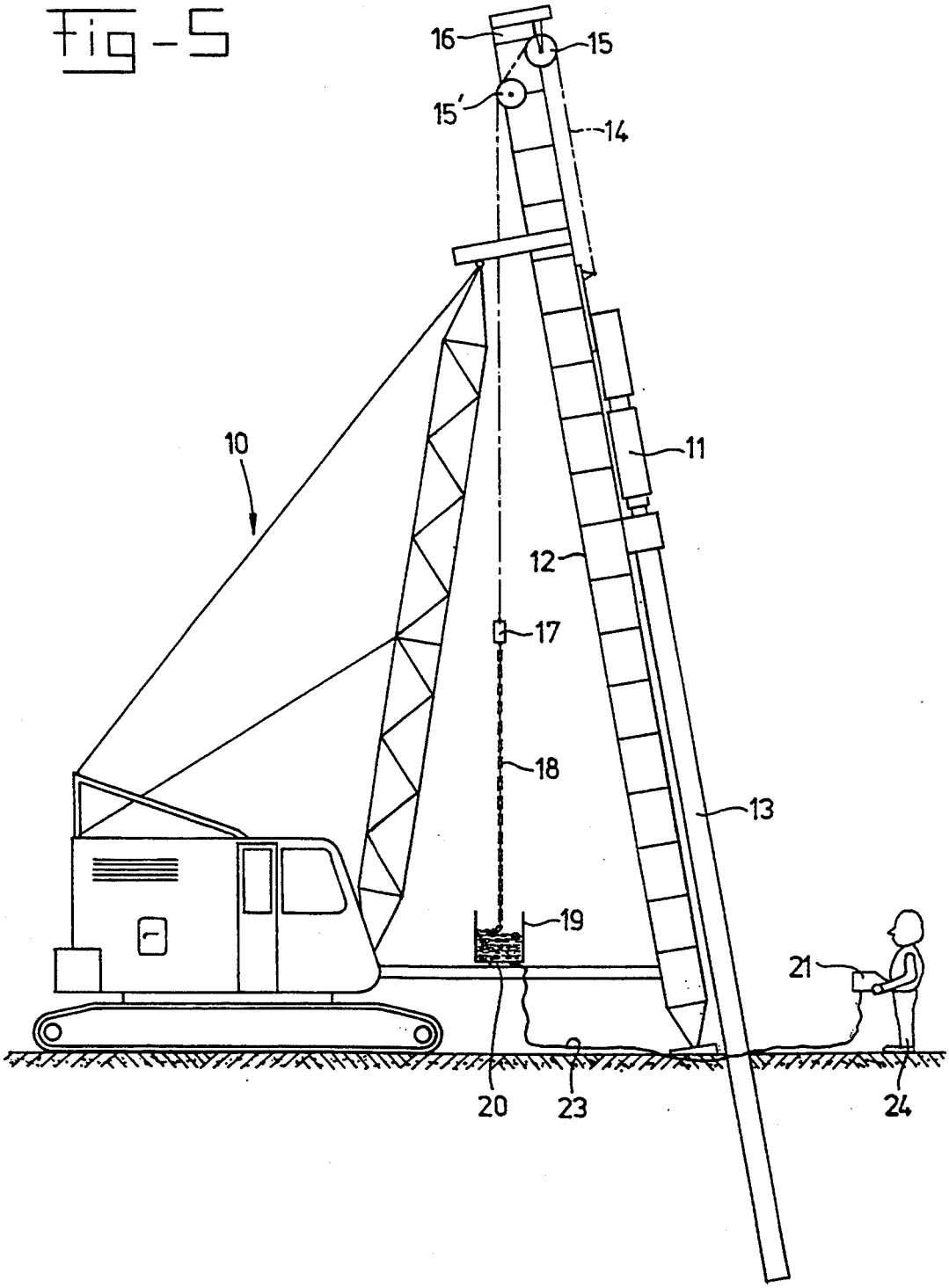
FIG. 5 illustrates the use of a system according to the invention in combination with an installation for driving a pile non-vertically into the ground.

FIG. 5 illustrates a practical situation whereby the pile is driven in a non-vertical direction into the ground. Under these circumstances it is possible (although not necessary) to locate the reservoir 19 outside the leader 12. The cable 14 runs from the pulley 15 eventually along a further pulley 15' and extends from there downwards until the connection 17 with the chain 18 which also runs in a vertical direction. The reservoir 19 is installed in a suitable position such that the weight of the whole reservoir can be measured by means of the weight sensor 20. The weight sensor 20 is through a cable 23 connected to the data processor/data logger 21 which in this case is embodied as a hand-held device, operated by a person 24.

Although the container 19 in the illustrated configuration rests upon constructional parts of the drilling rig 10 it will be clear that the container can also be placed on the ground as long as the weight sensor 20 is able to carry out its function.

The elongated element 18 can be embodied as a generally known chain made of a plurality of interconnected links of the type which is very schematically illustrated in FIG. 6. Therein the chain **18*a* comprises a number of ellipsoidal, round or otherwise suitable shaped interconnected links 22*a*, 22*b*, . . . 22*n***.

Another embodiment of an elongated flexible element is illustrated in FIG. 7. In this embodiment the flexible elongated element comprises a series of weight elements **23*a*, 23*b*, . . . 23*n* which are interconnected by means of small eyes 24*a*, 24*a'*, 24*b*, . . .** at both sides such that in fact a chain is formed.

Another embodiment is illustrated in FIG. 8 and consists of a wire or rope 25 carrying weight elements **26*a*, 26*b*, . . . 26*n*** at mutually equal distances.

Instead of a chain also a wire, cable or rope can be used as elongated flexible element (see embodiment illustrated in FIG. 4) as long as the uniformly distributed weight thereof is sufficient to enable accurate weight measurements by the sensor 20.

All the above-described embodiments were specifically directed to installations for driving a pile into the ground. As is already remarked in the introductory part of this specification the system can also be used in combination with installations for driving a sheet pile, a tube, a drill or other elongated objects into the ground. Furthermore the invention is not restricted to systems, in which impact hammers are used as tool for driving the elongated object into the ground. Instead of an impact hammer also a vibratory hammer can be used or, in case of drilling, a drill rotating head.

In case a vibratory hammer is used the signal derived from the sensor 20 has a somewhat different shape. FIG. 9 illustrates the respective signal consisting of an essentially monotonous descending oscillatory signal, the oscillations corresponding with the vibratory movement of the hammer unit. At successive time intervals the average value over a short time period is taken. If (a) is the reference level, at which the system was initiated, corresponding with ground level of the under surface of the pile, then (a–b), (a–c), etc. represents the penetration of the pile at each successive measurement. Again the penetration increment per time interval yields the penetration rate. The penetration rate is a measure for the resistance of the soil. The amplitude of the oscillating signal forms a measure for the power supplied by the vibratory hammer.

It is remarked that in this embodiment the time moments at which the main value are determined, are not related or synchronized with each blow of the hammer unit. In this case preferably the processor or data logger includes a timer which determines regular intervals at which the main values are determined.

In case the system is used for driving a drill into the ground, for instance for forming a bore hole in which a pile can be casted in situ, or for other purposes, then the signal will be a more or less smoothly decreasing signal as illustrated in FIG. 10. In the areas a, b, c, etc. at successive time intervals the mean value of a short time interval is taken. If (a) is the reference level (for instance ground level) then (a–b), (a–c), etc. represents the penetration of the pile at each successive measurement. The penetration increment per time interval yields then the penetration rate and the penetration rate is a measure for the resistance of the soil.

In the above-described embodiments the elongated object was driven into the ground. However, in most cases the same rigs or other rigs can be used to pull or otherwise remove elongated objects from the ground. Also under these circumstances the measuring system according to the invention can be applied with the same accurate results.

It is remarked that the invention is not restricted to the shown embodiments and that various other embodiments are conceivable without leaving the scope of the invention.

I claim:

1. An installation for driving an elongate object having a length into the ground or for removing said elongate object from the ground, and for measuring an amount of said length of said elongate object which is in the ground during said driving and said removing, comprising:

a flexible elongate element having a predetermined length, and a predetermined weight substantially uniformly distributed along said predetermined length, said predetermined length being longer than said object;

a supporting means for supporting said flexible elongate element, said flexible elongate element having an end and means for associating said end with said object so that said end moves synchronously with said object during said driving and said removing whereby a first portion of said flexible elongate element hangs from said associating means and a second portion of said flexible elongate element rests on said supporting means; and means for measuring a weight of at least one of said first portion and said second portion of said flexible elongate element, whereby said amount of said length of said object which is in the ground is determined from said weight.

2. An installation according to claim 1, further comprising means separate from said flexible elongate element for driving and removing said object from the ground whereby said flexible elongate element is substantially free of loads other than said first portion.

3. An installation according to claim 2, wherein said associating means comprises means for connecting said end to at least one of said object and means for said driving.

4. An installation according to claim 1, wherein the flexible elongate element comprises a chain made of a plurality of interconnected links.

5. An installation according to claim 1, wherein the flexible elongate element comprises a wire to which separate weight elements are connected at mutual distances.

6. An installation according to claim 1, wherein said first portion of the flexible elongate element hangs from said associating means above said supporting means and hangs down substantially vertically during operation of the installation.

7. An installation according to claim 1, wherein said associating means comprises a clamp through which said end of the flexible elongate element is connected to said object.

8. An installation according to claim 2, wherein said associating means comprises a clamp through which said end of the flexible elongate element is connected to means for said driving.

9. An installation according to claim 1, wherein said associating means comprises a wire extending between said end of the flexible elongate element and the object.

10. An installation according to claim 2, wherein said associating means comprises a wire extending between said end of the flexible elongate element and said means for driving.

11. An installation according to claim 1, wherein the supporting means is part of a container having at least a bottom and side walls, said container providing enough inner space to contain said flexible elongate element.

12. An installation according to claim 1, wherein said weight measuring means comprises a sensor installed underneath said supporting means to measure a combination of weight of said supporting means and said second portion of the flexible elongate element.

13. An installation according to claim 9, wherein said weight measuring means comprises a sensor installed between said end of the flexible elongate element and the wire.

14. An installation according to claim 7, wherein said weight measuring means comprises a sensor installed between said end of the flexible elongate element and said clamp.

15. An installation according to claim 8, wherein said weight measuring means comprises a sensor installed between said end of the flexible elongate element and said clamp.

16. An installation according to claim 1, further comprising a protective tubing surrounding at least a part of said first portion of said flexible elongate element.

17. An installation according to claim 1, wherein said weight measuring means is connected through a data communication link to a data processor/data logger.

18. An installation according to claim 17, wherein said data communication link comprises a wire connection between said weight measuring means and the data processor/data logger.

19. An installation according to claim 17, wherein said data communication link comprises a wireless communication path wherein at least said weight measuring means has a transmitter and at least the data processor/-data logger has a receiver.

20. A method for measuring an amount of a length of an object in the ground while said object is being driven into or removed from the ground, comprising the steps of:

providing a flexible elongate element having a predetermined length which is longer than said object and having a predetermined weight substantially uniformly distributed along said length;

associating an end of said flexible elongate element with said object with an associating means so that, as said object is moved relative to the ground, said end of said flexible elongate element moves synchronously with said object and said flexible elongated element has a first portion hanging from said associating means and a second portion resting on a support surface;

measuring a weight of at least one of said first portion and said second portion at a desired time; and determining said amount of length of said object in the ground from said measured weight.

* * * * *